US007523705B2

(12) United States Patent
Richards et al.

(10) Patent No.: US 7,523,705 B2
(45) Date of Patent: Apr. 28, 2009

(54) WEB PRINTING PRESS AND METHOD FOR CONTROLLING PRINT-TO-CUT AND CIRCUMFERENTIAL REGISTER

(75) Inventors: John Sheridan Richards, Barrington, NH (US); Charles Reif Hammond, Durham, NH (US)

(73) Assignee: Goss International Americas, Inc., Dover, NH (US)

( * ) Notice: Subject to any disclaimer, the term of this patent is extended or adjusted under 35 U.S.C. 154(b) by 778 days.

(21) Appl. No.: 10/795,540

(22) Filed: Mar. 8, 2004

(65) Prior Publication Data

US 2005/0193907 A1 Sep. 8, 2005

(51) Int. Cl.
*B41F 13/60* (2006.01)

(52) U.S. Cl. ..... 101/486; 101/483

(58) Field of Classification Search ..... 101/216, 101/224, 225, 226, 484, 483, 485, DIG. 42, 101/486

See application file for complete search history.

(56) References Cited

U.S. PATENT DOCUMENTS 4,955,265 A * 9/1990 Nakagawa et al. ..... 83/74
5,016,182 A * 5/1991 Bergland et al. ..... 700/125
5,438,926 A * 8/1995 Hudyma et al. ..... 101/227
5,452,632 A * 9/1995 Durr et al. ..... 83/13
5,458,062 A * 10/1995 Goldberg et al. ..... 101/227
5,740,054 A * 4/1998 Durr et al. ..... 700/122
6,092,466 A * 7/2000 Koch et al. ..... 101/485
6,321,650 B1 * 11/2001 Ogawa et al. ..... 101/227
6,546,871 B1 * 4/2003 Glockner ..... 101/484
6,601,506 B2 8/2003 Dauer
6,644,184 B1 11/2003 Hajek et al.
6,748,857 B2 * 6/2004 Seiler et al. ..... 101/226
6,837,159 B2 * 1/2005 Elkotbi ..... 101/219
2001/0027731 A1 * 10/2001 Schramm ..... 101/216
2003/0066444 A1 * 4/2003 Hajek et al. ..... 101/217
2003/0066451 A1 * 4/2003 Mengisen et al. ..... 101/485
2003/0084765 A1 5/2003 Elktobi et al.
2004/0025725 A1 2/2004 Seiler et al.

* cited by examiner

*Primary Examiner*—Daniel J Colilla
(74) *Attorney, Agent, or Firm*—Davidson, Davidson & Kappel, LLC

(57) ABSTRACT

A method for controlling the print-to-cut register in a web printing press having at least one print unit printing a web, each print unit having at least one drive driving the print unit independently of the other print units. The method includes presetting a web compensator position so as to set a print-to-cut registration between a print unit and a cross-cutter and controlling the print-to-cut register during printing by controlling the drives of the print units and/or a drive of the cross-cutter. A method for controlling circumferential register, as well as a printing press are also disclosed.

5 Claims, 2 Drawing Sheets

WEB PRINTING PRESS AND METHOD FOR CONTROLLING PRINT-TO-CUT AND CIRCUMFERENTIAL REGISTER

BACKGROUND OF THE INVENTION

The present invention relates generally to web printing presses and more particularly to a web printing press with register control and a method for controlling print-to-cut and/or circumferential registration of a web.

A web printing press, for example for a newspaper printing press, will print a continuous web of material in one or more print units. In a folder of the printing press, the web will be folded, if desired, and then cut, so that signatures result.

U.S. Pat. Nos. 6,601,506 and 6,644,184 purport to disclose web-fed offset printing machines in which each print unit is separately driven, and the cut and/or color register is controlled by presetting the rotary angle positions of the printing cylinders.

U.S. Patent Publication No. 2003/0084765 discloses a device for positioning a cross cut relative to printed images using phase angle adjustments between a print unit and a cross-cutter, and also using a path length variation device, for example a web compensator. This patent application is hereby incorporated by reference herein, as are U.S. Pat. Nos. 6,601,506 and 6,644,184.

BRIEF SUMMARY OF THE INVENTION

Presetting of the print-to-cut register or circumferential register in a shaftless printing press without using web compensators often requires coordinated movement of all drive motors for each print unit.

The use of web compensators to adjust the registration of the printed images with respect to a downstream cross-cutter or with respect to consecutive print units printing a same web often requires a precision design to be able to adjust the register during printing and for presetting the cut registration for varying job requirements. Continuous moving adjustments, often of relatively small phasing amounts in response to a closed-loop phase correction system, may be required.

An object of the present invention is to permit efficient presetting of the print-to-cut and/or circumferential register. An alternate or additional object of the present invention is to permit for less precise or less costly web compensators or control systems for the web compensators for register presetting.

The present invention provides a method for controlling the print-to-cut register in a web printing press having at least one print unit printing a web, each print unit having at least one independent drive, the method comprising the steps of:

presetting a web compensator position so as to set a print-to-cut register between a print unit and a cross-cutter; and controlling the print-to-cut register during printing by controlling the drive of the print unit.

Controlling the print-to-cut register during printing by controlling the drive of the print unit as defined herein means the drive of the print unit is used to control the register so that the web compensator is not controlled to respond to variations during printing in the print-to-cut register. The web compensator is maintained in position during printing, or moved without feedback or operator control related to the print-to-cut register.

By using the web compensator to adjust the preset values, and then controlling the print-to-cut register using the motors during printing, the requirement for precise control and movement of the web compensator during printing can be eliminated.

A print cylinder position, e.g. a position of a plate cylinder or blanket cylinder, thus need not be preset to alter the print-to-cut register, for example if different products are being printed.

The angular position of a cylinder of the print unit at the end of a print job is completed may be stored. The position of the compensator and the angular position of the cross-cutter may also be stored together with the print cylinder position information. The actual print-to-cut registration for the print job may also be calculated and stored.

The cross-cutter position however also can be set at the end of each print job to a reference position, so that the cross-cutter position need not be stored with the compensator position information.

When the compensator is preset for the next print job, the information can then be used to provide a proper print-to-cut register between the print couples and the knife of the cross-cutter for a next print job. The print cylinder and/or cross-cutter need not be moved at all. The proper print-to-cut register may be set for example based on stored values of the angular position of the print cylinder, the cross-cutter and the compensator for similar previous print jobs, and on the current angular position of the print cylinder and the cross-cutter.

The cross-cutter however can also be preset before each print run to an exact same position, i.e. the reference position, and the compensator preset to provide the proper print-to-cut registration.

During printing, running adjustments to the drive motors to adjust the phase of the print cylinder relative to the knife of the cross-cutter can be made by an operator, or via sensing of marks or images on the web with a closed-loop feedback control, to improve the accuracy of the print-to-cut register. If a plurality of print couples are present, all drive motors may be adjusted a similar amount so that color register is not altered.

The present invention provides also provides a method for controlling the circumferential register in a web printing press having a plurality of print units printing a web, each print unit having at least one drive, the method comprising the steps of:

presetting a web compensator position so as to preset a circumferential register between a first print unit and a second print unit; and controlling the circumferential register between the first and second print unit during printing by controlling the drives of the print units.

By controlling the circumferential register by controlling the drives, the web compensator can be maintained in position, or moved without operator or feedback control related to the circumferential register.

The present invention also provides a web printing press including at least one print unit having a cylinder for printing a web, and a drive motor for driving the cylinder independently of any further print units;

a web compensator downstream of the print unit for adjusting a path length of the web;

a cross-cutter downstream of the web compensator for cutting the web; and a controller for controlling the web compensator and the drive motor, the controller presetting the web compensator to a position, and controlling the drive motor during printing to maintain a print-to-cut register.

The present invention also provides a web printing press including a first print unit, a second print unit, and a third print unit, the web being capable of being fed so as to be printed by two printing print units of the first, second and third print units, a first drive motor for driving the first print unit independently of the second and third print units, a second drive motor for driving the second print unit independently of the first print unit and third print units, and a third drive motor for driving the third print unit independently of the first and second print units;

a web compensator located downstream of at least the first print unit for adjusting a path length of the web; and a controller for controlling the web compensator and the first, second and third drive motors, the controller presetting the web compensator to a position dependent on a path of the web between the two printing print units of the first, second and third print units, and controlling the drive motor during printing to maintain a circumferential register between the two printing print units.

BRIEF DESCRIPTION OF THE DRAWINGS

The following figure shows a preferred embodiment of the present invention in which.

DETAILED DESCRIPTION

Figure 1:
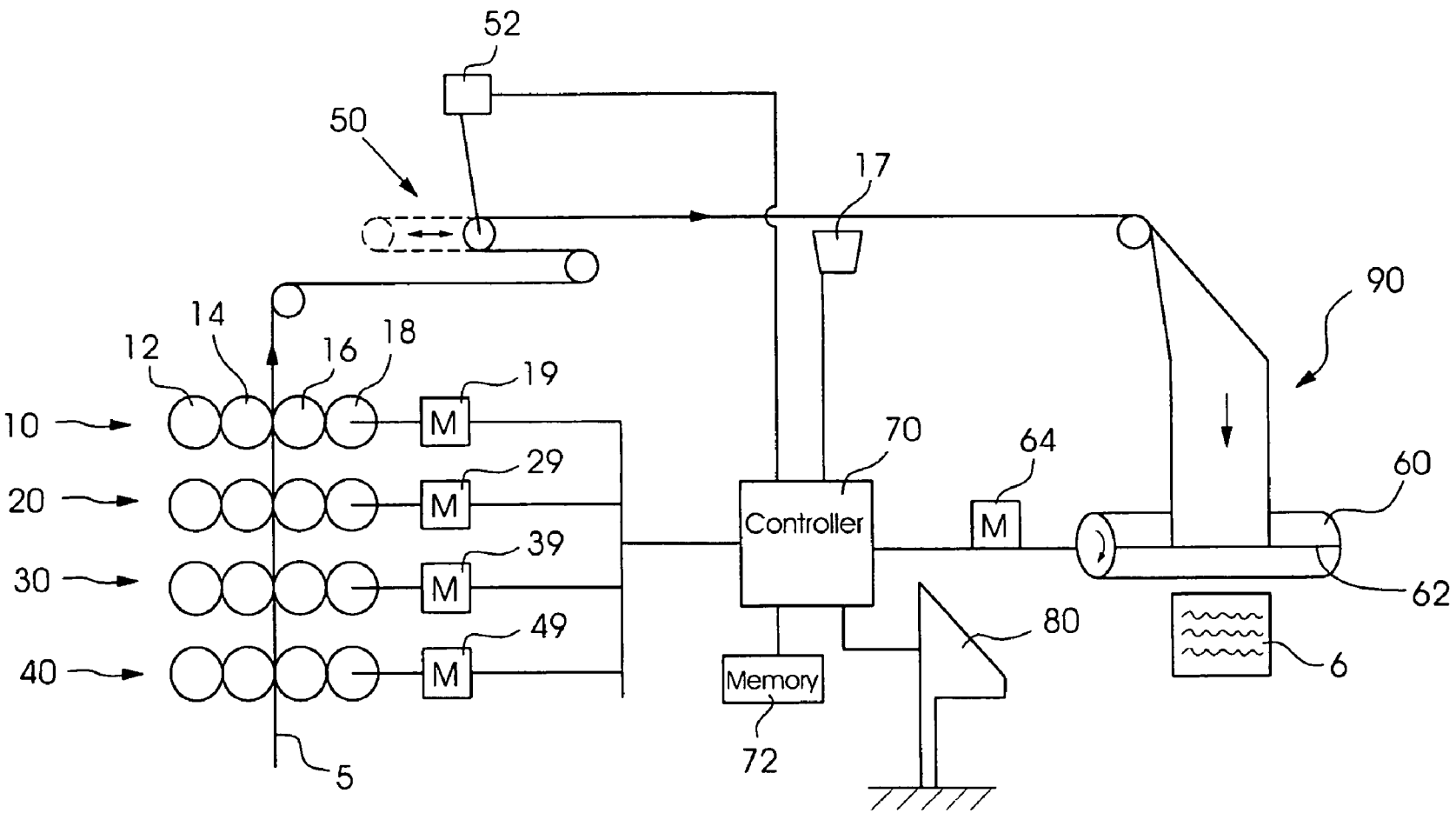
FIG. 1 shows an embodiment of an offset lithographic web printing press according to the present invention with print-to-cut registration control.

FIG. 1 shows a multicolor offset lithographic shaftless printing press according to the present invention, in which a web 5 is printed and cut into signatures 6, such as newspapers.

Print units 10, 20, 30, 40 each include, in this embodiment, a plate cylinder 12, blanket cylinder 14, blanket cylinder 16, and plate cylinder 18. The cylinders 12, 14, 16, 18 of each print unit 10, 20, 30, 40 are driven independently by motors 19, 29, 39, 49, respectively. A controller 70 controls the motors and can receive inputs from a sensor 17 which can read marks or image locations on web 5. Each print unit 10, 20, 30, 40 may, for example, print a different color, for example, cyan, magenta, yellow and black to create four-color images.

The controller 70 thus can drive the motors 19, 29, 39, 49 to set proper color registration using the inputs from the sensors 17. Alternately an operator at a control console 80 can alter the phasing between the motors 19, 29, 39 or 49 to adjust the proper color registration. While cylinders 12, 14, 16, 18 are geared together in the example shown and driven by a single drive motor 19, it should be noted that print unit 10 may have more than one drive motor 19 for the cylinders 12, 14, 16, 18. For example, drive motors can be provided for each print couple.

Controller 70, which may include more than one processor, also controls a web compensator 50 through a compensator position actuator and sensor 52. The web compensator 50 moves as shown by the double arrows to alter the web path length and thus the print-to-cut register between the print units 10, 20, 30, 40 and a cross-cutter 60 having a knife 62 located in a folder 90 of the printing press. Cross-cutter 60 may include an anvil cylinder against which knife 62 acts, and a drive motor 64. Drive motor 64 may provide a reference position signal so that drive motors 19, 29, 39, 49 may be adjusted to adjust the phase of the print units with respect to the cross-cutter. However, the phase of the drive motor 64 also could be adjusted.

The desired print-to-cut registration for different products or print jobs may change, and thus various preset positions for the web compensator 50 may be stored in a memory 72. For example, the print units 10, 20, 30, 40 can print four images axially, and one circumferentially, i.e. be a 4:1 press. The web then can be slit in folder 90 to produce various tabloid or broadsheet print jobs with different print-to-cut registration requirements. When an operator chooses a particular print job or product type at console 80, the web compensator 50 can move into the stored preset position proper for that particular job.

The proper print-to-cut registration depends on the actual web path length between the nip formed by blanket cylinders 14, 16, and the nip of the knife 62 with an anvil cylinder, which can be a known distance for example from sensors reading markings on the web or from construction of the printing press, as well as the position of web compensator 50. The actual print-to-cut registration then also depends on the angular position of the cylinders 14, 16 with respect to the knife 62 on cutter 60, and the size of these cylinders.

The position of a plurality of web compensators, as shown in incorporated-by-reference U.S. Patent Application No. 2003/0084765 may also be preset after the last print unit. A plurality of webs may also be fed from other print units to folder 90.

Figure 2:
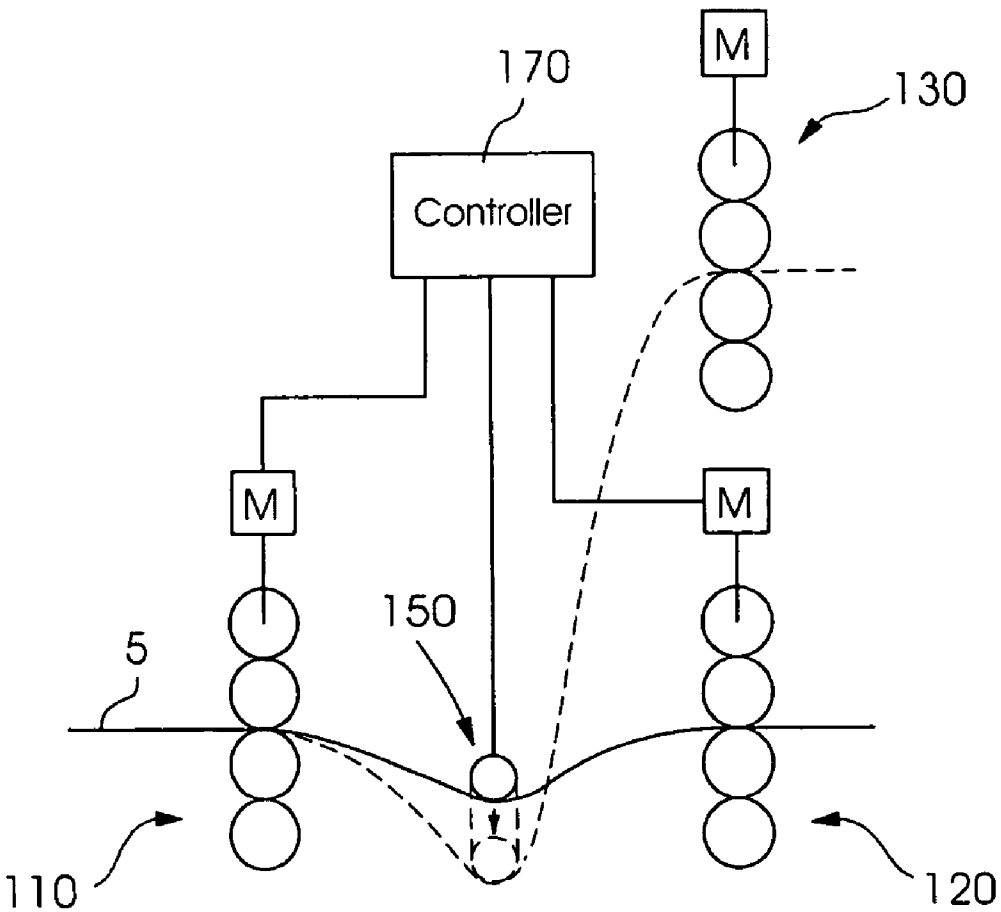
FIG. 2 shows an embodiment of an offset lithographic web printing press according to the present invention with registration control between print units.

FIG. 2 shows an alternate embodiment where the web path between print units 110, 120, 130 may change, for example to use an imprinter unit. It thus may be desirable to preset a web compensator 150 to certain positions if the web 5 runs between print unit 110 and 120, and to other positions if the web 5 runs between print unit 110 and 130. A controller 170 with access to a memory can store the preset positions of the web compensator 150, and control the circumferential registration, for example color registration, between the print unit 110 and print unit 120, or between print unit 110 and print unit 130 during a printing operation. The proper circumferential register is thus a function of the actual path length distance between the nips of print unit 110 and 120 or print unit 110 and 130, as well as the relative position of the images on the cylinders of the print units 110 and 120 or print unit 110 and 130.

It should be noted that with proper angle bars the web 5 may also be routed to first enter print unit 130, wrap around web compensator 150 and exit through print unit 120.

What is claimed is:

1. A method for controlling the print-to-cut register in a web printing press having at least one print unit printing a web, each print unit having at least one drive driving the print unit independently of any other print units, the method comprising the steps of:

presetting a web compensator position so as to set a proper print-to-cut registration between a print unit and a cross-cutter; and controlling the print-to-cut register during printing by controlling the drives of the print units and/or a drive of the cross-cutter; and storing a first value, the first value being a function of an angular position of a cylinder of the print units and/or the cross-cutter after a print job.

2. The method as recited in claim 1 further comprising storing a second value, the second value being a function of a position of the compensator, the second value being stored together with the first value.

3. The method as recited in claim 1 wherein the cylinder is maintained in the position for a second print job, and further comprising presetting a position of the web compensator for the second print job as a function of at least one other value, the at least one other value being a function of a previous position of the web compensator and a previous angular position of the cylinder with respect to the cross-cutter, the at least one other value being stored in a memory.

4. A method for controlling the print-to-cut register in a web printing press having at least one print unit printing a web, each print unit having at least one drive driving the print unit independently of any other print units, the method comprising the steps of:

presetting a web compensator position so as to set a proper print-to-cut registration between a print unit and a cross-cutter; and controlling the print-to-cut register during printing by controlling the drives of the print units and/or a drive of the cross-cutter, wherein the web contacting the web compensator is not slit.

5. A method for controlling the print-to-cut register in a web printing press having at least one print unit printing a web, each print unit having at least one drive driving the print unit independently of any other print units, the method comprising the steps of:

presetting a web compensator position so as to set a proper print-to-cut registration between a print unit and a cross-cutter; and controlling the print-to-cut register during printing by controlling the drives of the print units and/or a drive of the cross-cutter, wherein the web is slit after the web compensator.

* * * * *